US006899258B2

(12) United States Patent
Haramiishi

(10) Patent No.: US 6,899,258 B2
(45) Date of Patent: May 31, 2005

(54) CARTRIDGE

(75) Inventor: Kiichi Haramiishi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/486,436

(22) PCT Filed: Aug. 9, 2002

(86) PCT No.: PCT/JP02/08183

§ 371 (c)(1),
(2), (4) Date: Feb. 9, 2004

(87) PCT Pub. No.: WO03/013801

PCT Pub. Date: Feb. 20, 2003

(65) Prior Publication Data

US 2004/0200875 A1 Oct. 14, 2004

(30) Foreign Application Priority Data

Aug. 9, 2001 (JP) ..... 2001-242741
Aug. 13, 2001 (JP) ..... 2001-245595

(51) Int. Cl.[7] ..... B27F 7/36

(52) U.S. Cl. ..... 227/2; 227/120; 227/131; 227/136

(58) Field of Search ..... 227/2, 4, 119, 227/120, 131, 136; 270/58.07, 58.08, 58.09; 221/197, 198

(56) References Cited

U.S. PATENT DOCUMENTS 4,623,082 A * 11/1986 Kurosawa ..... 227/7
4,770,334 A * 9/1988 Hoshi et al. ..... 227/85
5,230,457 A * 7/1993 Hiroi et al. ..... 227/2
5,346,114 A * 9/1994 Udagawa et al. ..... 227/120
5,535,937 A * 7/1996 Boiarski et al. ..... 227/175.3
5,560,529 A * 10/1996 Udagawa et al. ..... 227/136
5,836,502 A * 11/1998 Kanai et al. ..... 227/131
5,975,396 A * 11/1999 Manabe ..... 227/2
6,050,471 A * 4/2000 Yagi ..... 227/119
6,371,352 B1 * 4/2002 Mochizuki ..... 227/155
6,474,633 B1 * 11/2002 Hirai ..... 270/58.09
6,568,579 B2 * 5/2003 Mochizuki ..... 227/131

* cited by examiner

*Primary Examiner*—Scott A. Smith
(74) *Attorney, Agent, or Firm*—Chapman and Cutler LLP

(57) ABSTRACT

A cartridge comprises a sheet staple detecting mechanism (60) for detecting presence and absence of sheet staples (ST) stacked on a bottom having an opening (23A). The sheet staple detecting mechanism (60) includes a detected member (30) having leg parts (32, 32, 33 and 33), which are disposed on the uppermost surface of the stacked sheet staples (ST) and configured to be inserted in the opening (23A) when the sheet staples (ST) are not disposed on the bottom (23), an actuator (40) rotated at the time the leg parts (32, 32, 33 and 33) are inserted in the opening (23 A), and a micro-switch (50) for detecting the rotation of the actuator (40).

12 Claims, 18 Drawing Sheets

CARTRIDGE

FIELD OF THE INVENTION

The present invention relates to a cartridge for an electric stapler configured to contain therein sheet staples.

BACKGROUND ART

Conventionally, there has been known a detecting mechanism for detecting presence and absence of sheet staples ST stacked in a cartridge (not shown) as shown in FIG. 23.

The detecting mechanism is composed of an actuator 1 provided below the stacked sheet staples ST and a micro-switch 2. If the sheet staples are absent in the cartridge, the actuator 1 rotates about a shaft 3 in a clockwise direction and then the micro-switch 2 detects the clockwise rotation of the actuator 1, as a result, the presence and absence of the sheet staples ST are detected.

By the way, in such a detecting mechanism for the sheet staples, because the actuator 1 and micro-switch 2 are disposed below the stacked sheet staples ST, an electric staple cannot be miniaturized. In addition, in an electric staple having a driver unit and a clincher unit which are separated upwardly and downwardly, because a paper is passed between the driver unit and clincher unit, there is a problem that providing the detecting mechanism below the cartridge is difficult, and so on.

Moreover, a cartridge 5, as shown in FIG. 24, is provided with a roller 7 for sending sheet staples ST to a transport path 6. A driver DP and a forming plate FP are disposed movably upwardly and downwardly above a front end (left end region in FIG. 24) of the transport path 6 to form a staple in a U shape by lowering the forming plate FP and to drive out the formed U-shaped staple toward a sheet bundle T by lowering the driver DP.

Contained in a containing part 5A of the cartridge 5 is a case 8 in which the sheet staples ST are stacked, as shown in FIG. 25. The stacked sheet staples ST are combined by a tape TP which is removed at the time the sheet staples are contained in the containing part 5A of the cartridge 5.

In the cartridge 5, the lowest sheet staple ST is sent to the transport path 6 by the roller 7, while, if the sheet staple ST is curved in such a manner that a central portion thereof becomes convex below in their back and forth, because forward and backward ends of the sheet staple ST become in a raised state, and therefore there is a problem that the forward end is caught on an upper edge of an entrance of the transport path 6 and the sheet staple ST cannot be sent to the transport path 6.

SUMMARY OF THE INVENTION

It is an object of the present invention to provide a cartridge which makes it possible to apply to an electric stapler of an upper and lower separated type and capable of intending a miniaturization of an electric stapler.

It is another object of the preset invention to provide a cartridge in which a sheet staple can be sent to a transport path firmly, even if the sheet staple is curved.

To attain the above former object, in claim 1, a cartridge according to the present invention is characterized by comprising a sheet staple detecting mechanism for detecting presence and absence of sheet staples stacked on a bottom having an opening, the sheet staple detecting mechanism including a detected member having a leg part which is laid on the uppermost sheet staple of the stacked sheet staples, when a sheet staple is not laid on the bottom, the leg part being entered in the opening of the bottom and the detected member is in a lowered position, and a detecting means for detecting the presence and absence of the sheet staple by detecting whether or not the detected member is moved to the lowered position in the opening.

To attain the another object, in claim 4, the present invention is characterized in that the cartridge comprises a drive out part for driving the sheet staple, a transport path for sending the sheet staple to the drive out part, and an inclined means for inclining the sheet staple by lifting a back portion of the sheet staple when the sheet staple is sent.

(A) is a perspective view showing a slide plate.

(B) is a sectional view showing the slide plate.

(C) is a plan view showing a feeding pawl.

FIG. 18

(A) is a perspective view showing a lower plate.

(B) is a perspective view showing a state that an upper plate is mounted on the lower plate.

Figure 19:
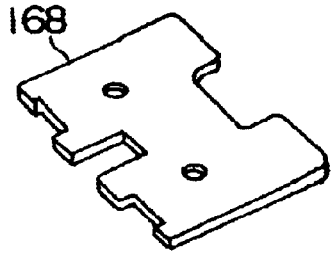

FIG. 19 is a plan view showing the upper plate.

Figure 20:
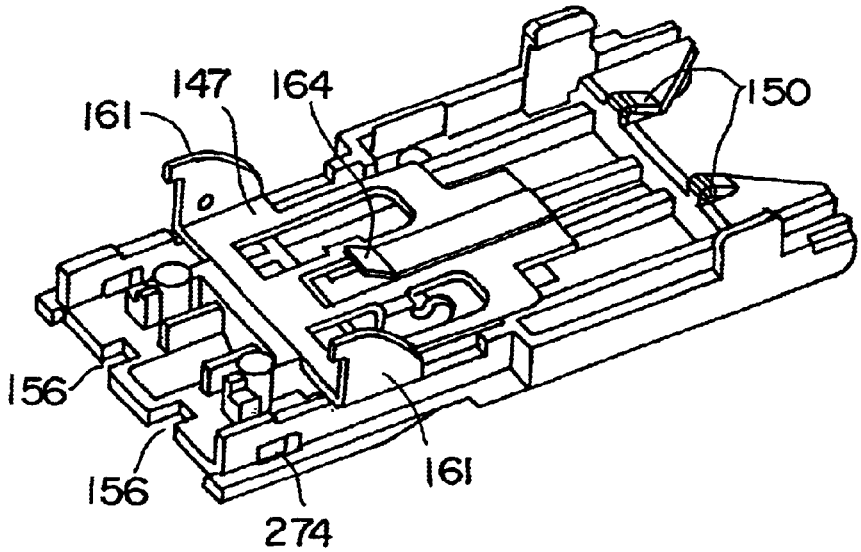

FIG. 20 is a perspective view showing a state that the slide plate is mounted on the supporting base.

Figure 21:
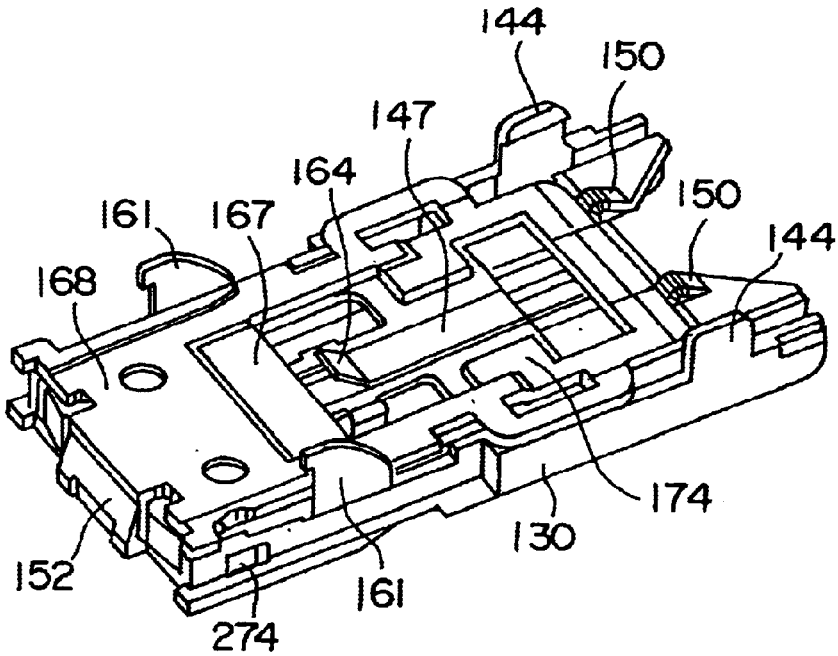

FIG. 21 is a perspective view showing a state that the slide plate and upper and lower plates are mounted on the supporting base.

Figure 22:
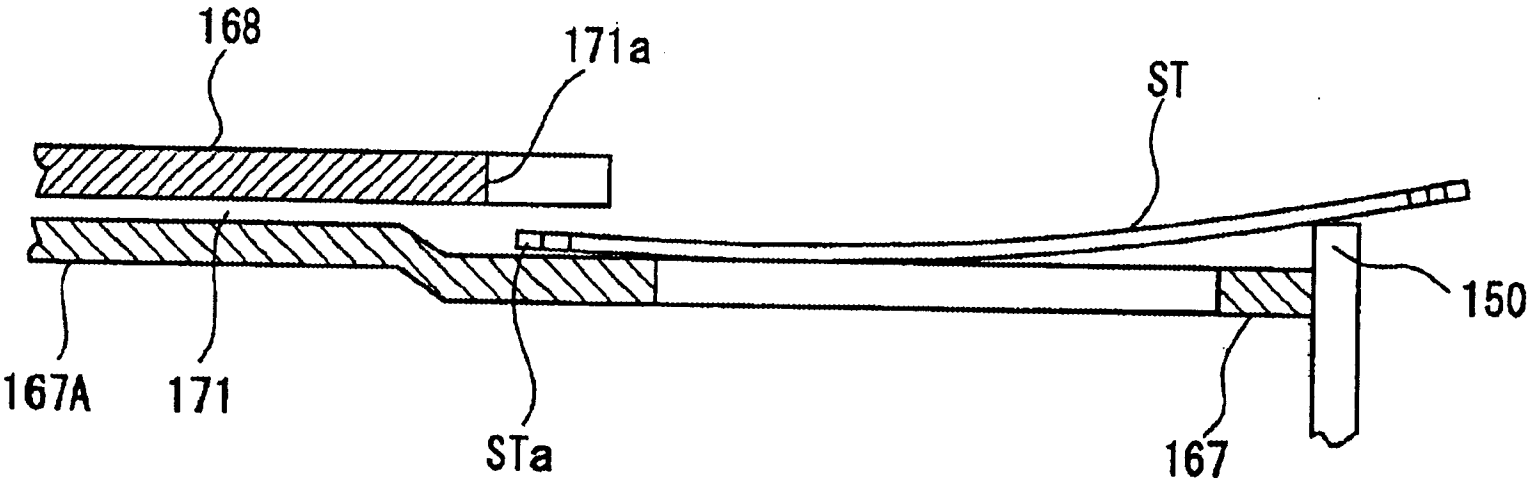

FIG. 22 is an explanatory view showing that the sheet staple is fed to the transport path even if the sheet staple is curved.

Figure 23:
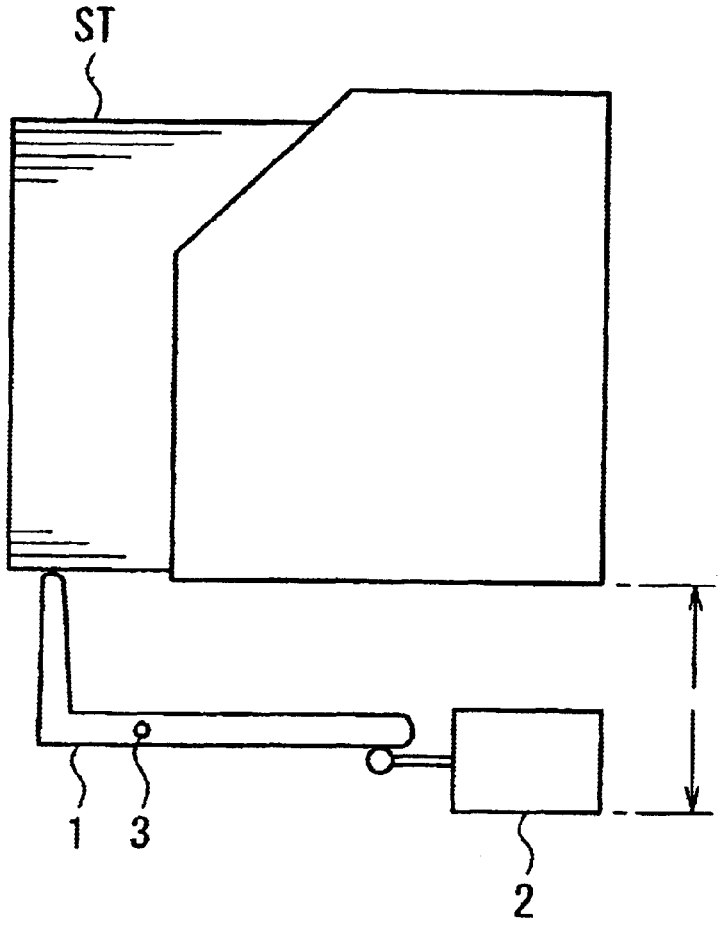
FIG.23 Prior Art

FIG. 23 is an explanatory view showing a conventional detecting mechanism.

Figure 24:
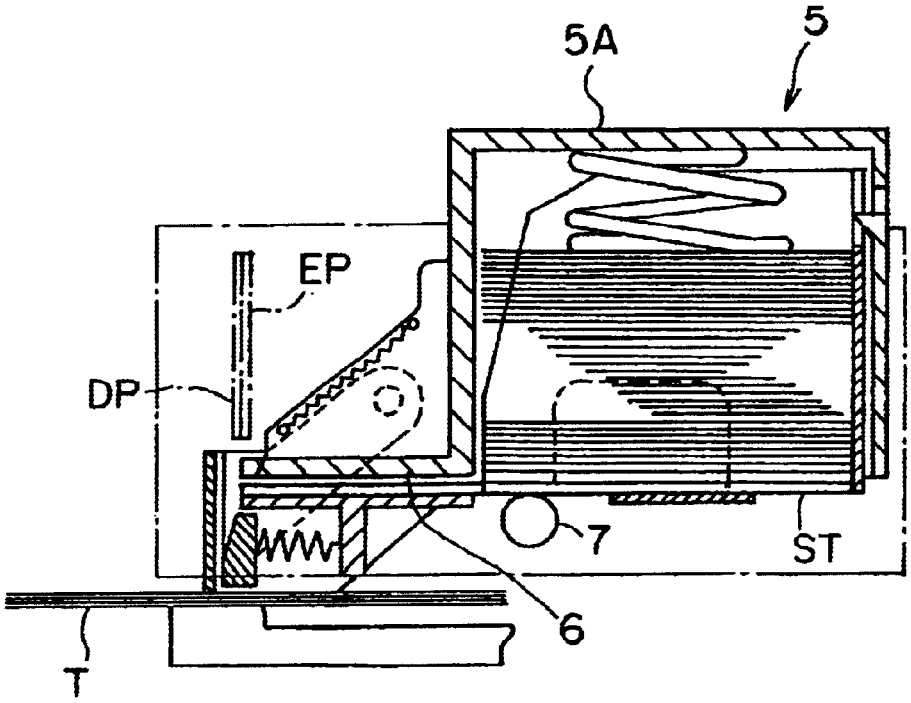
FIG.24 Prior Art

FIG. 24 is an explanatory view showing a conventional cartridge.

Figure 25:
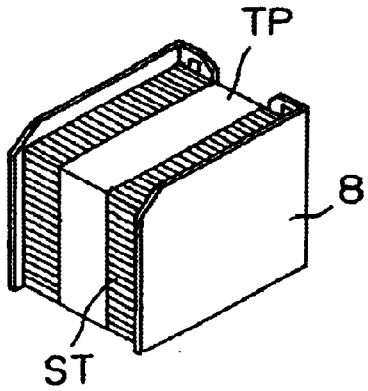
FIG.25 Prior Art

FIG. 25 is an explanatory view showing a state that the stacked sheet staples are contained in the containing case.

BEST MODE FOR CARRYING OUT THE INVENTION

A mode for carrying out a cartridge according to the present invention will be explained with reference to the accompanying drawings below.

First Mode for Carrying Out

Figure 1:
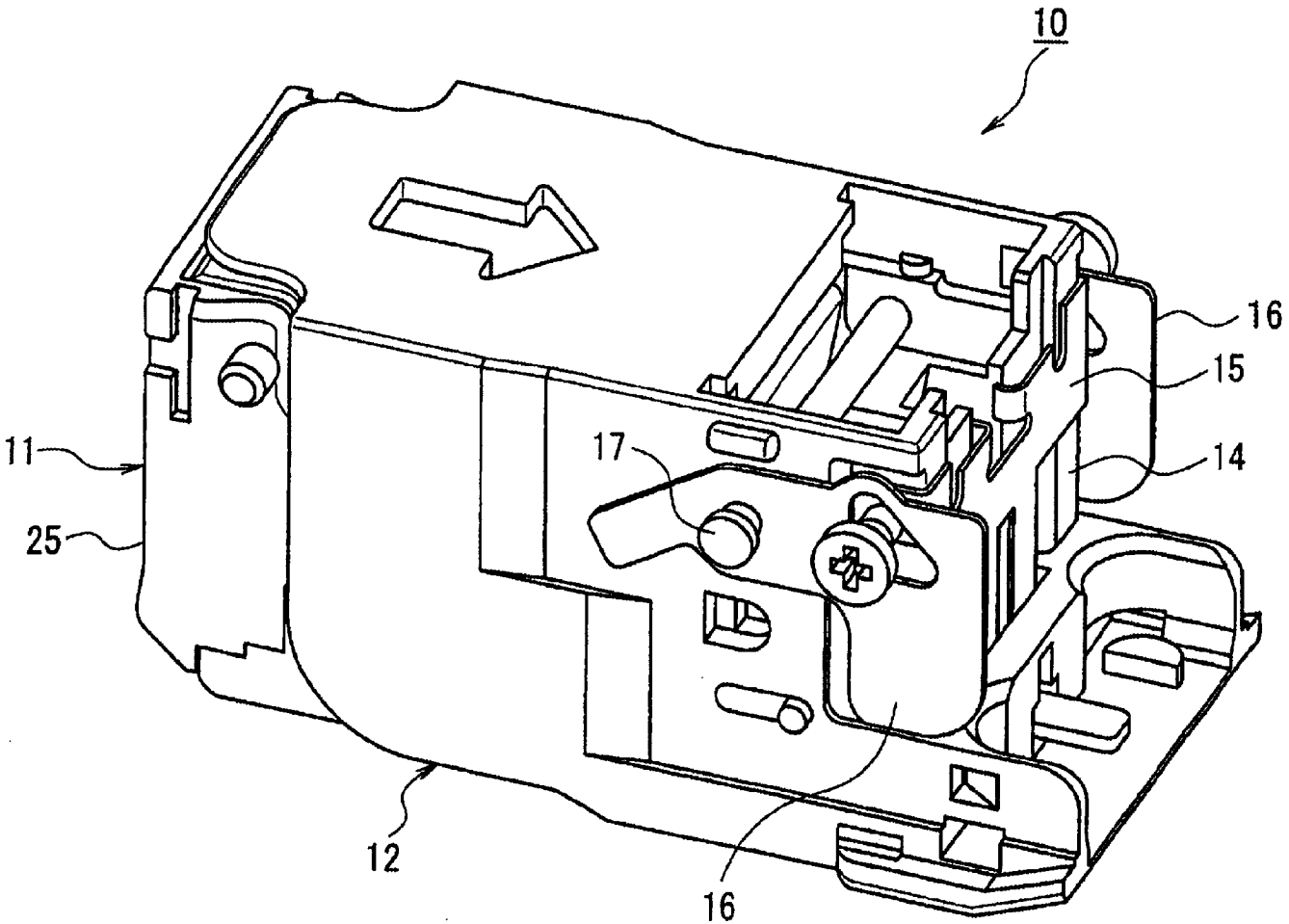
FIG. 1 is a perspective view showing a driver unit provided with a sheet staple detecting mechanism, according to the present invention.
Figure 2:
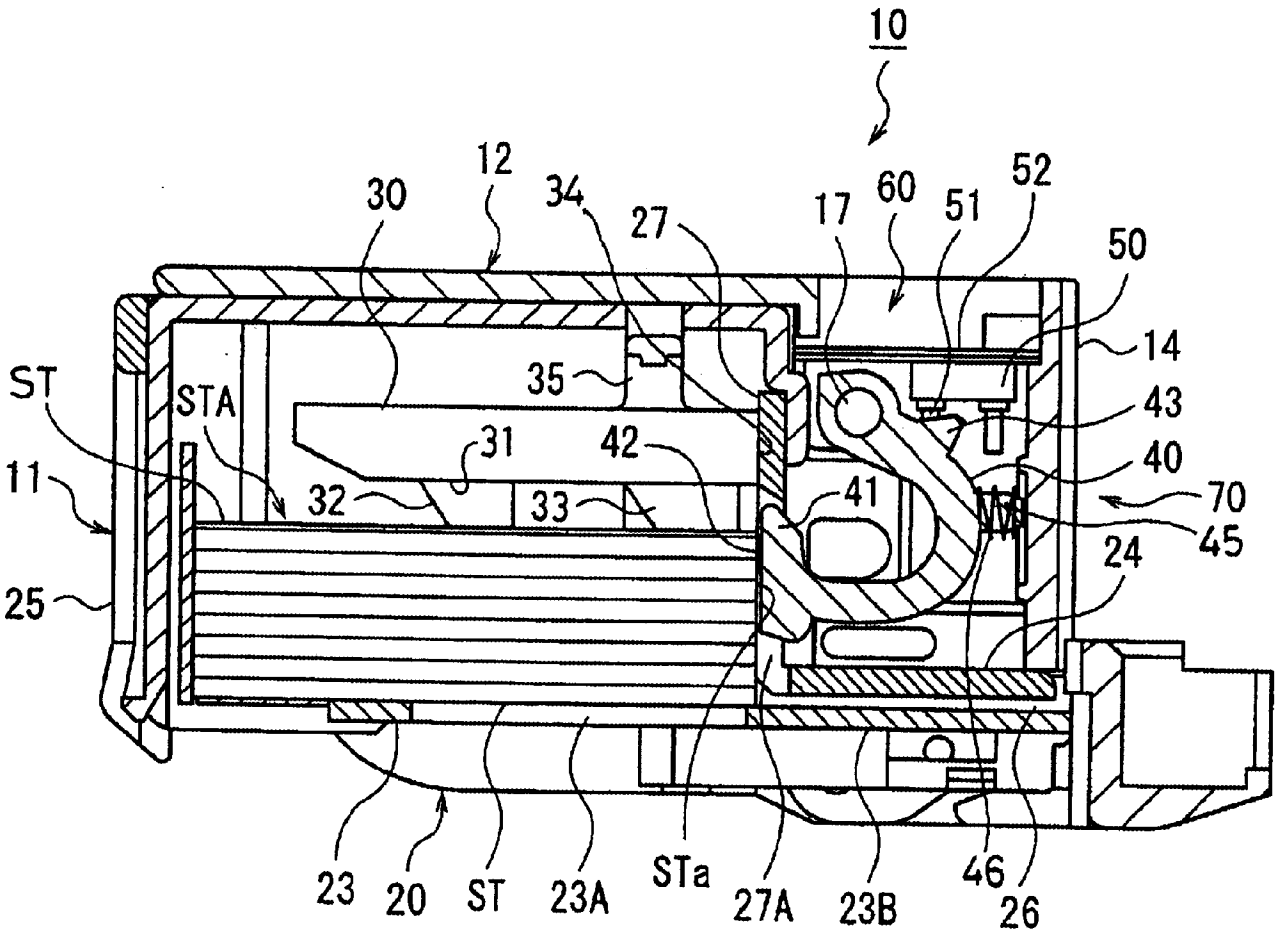
FIG. 2 is a sectional view showing a structure of the driver unit shown in FIG. 1.
Figure 3:
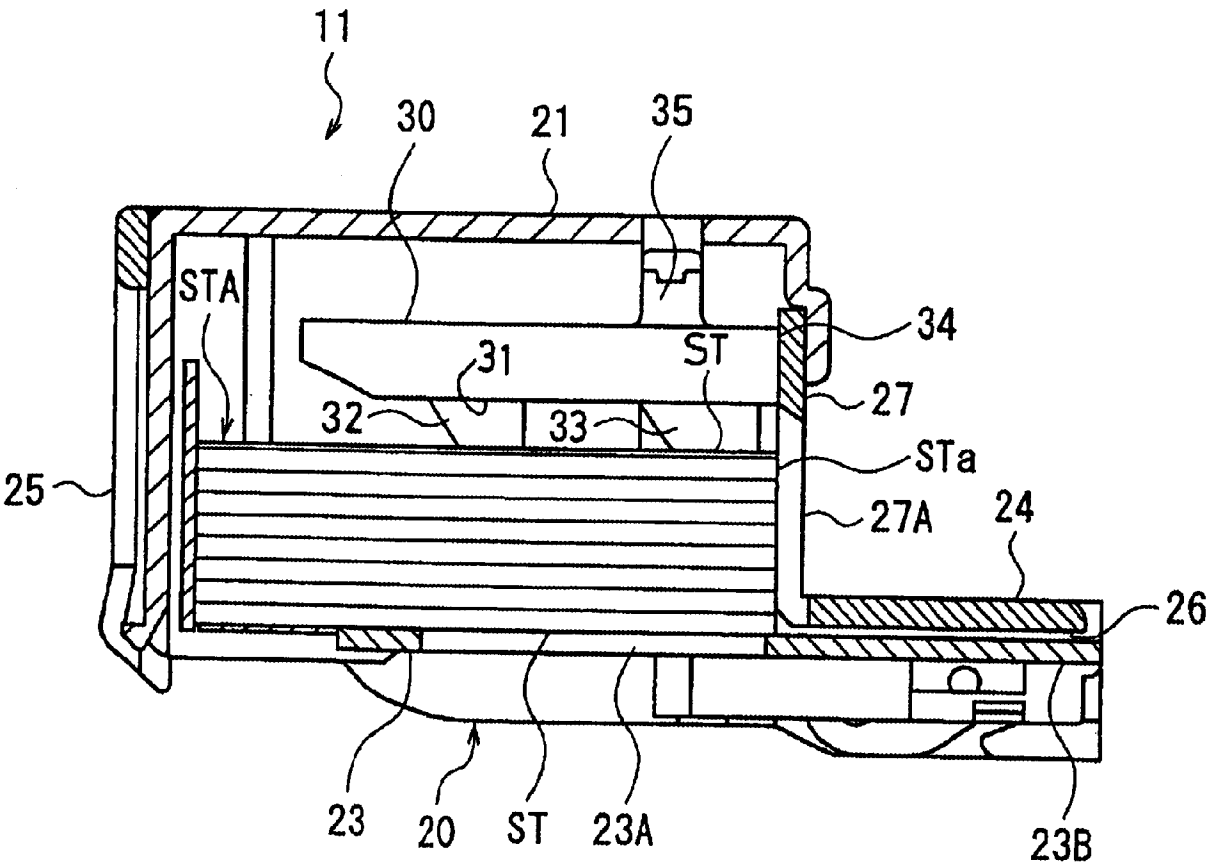
FIG. 3 is a sectional view showing a cartridge.
Figure 4:
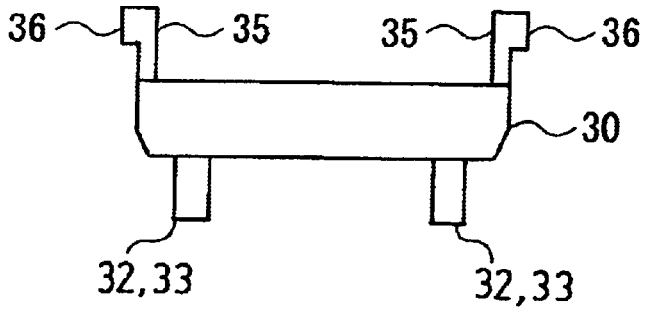
FIG. 4 is an explanatory view showing a detected member.
Figure 5:
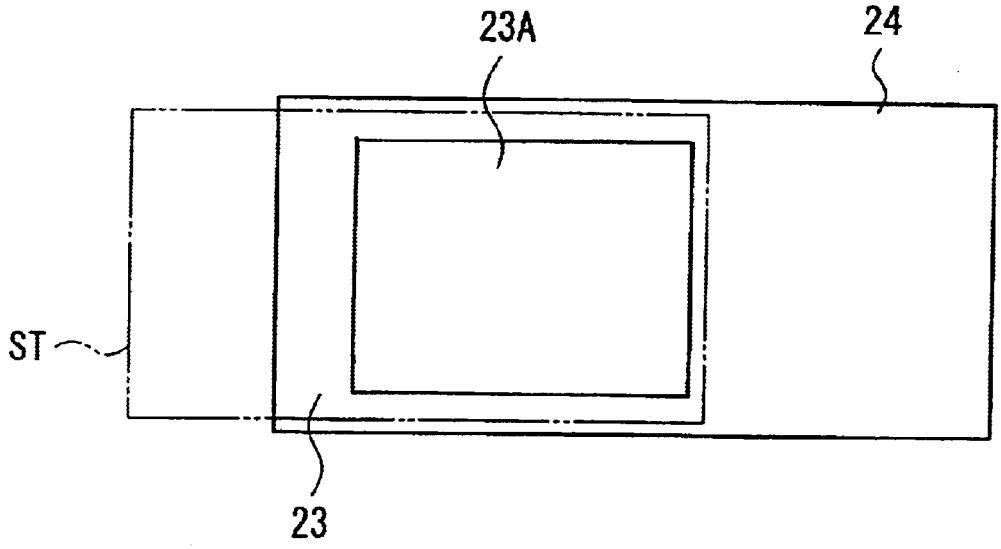
FIG. 5 is an explanatory view showing a bottom wall of a cartridge body.

In FIGS. 1 and 2, reference numeral 10 is a driver unit for an electric stapler of an upwardly and downwardly separated type. The driver unit 10 comprises a cartridge 11 in which sheet staples ST are stacked, a magazine 12 to which the cartridge 11 is removably attached, a driver 15 attached movably upwardly and downwardly to a front wall 14 of the magazine 12, a detecting mechanism 60 for detecting presence and absence of the stacked sheet staples ST and so on. Reference numeral 16 is a link member for rotating about a shaft 17, which causes a sending pawl (for sending the sheet staples forwardly), which is not shown to move backwardly against a biasing force of a spring (not shown), when the driver 15 is lowered.

The cartridge 11 has a cartridge body 20, a case 21 mounted removably on the cartridge body 20, a mounted base or detected member 30 attached movably upwardly and downwardly in the care 21 and so on.

The sheet staples ST are contained and stacked in the case 21 and the detected member 30 is disposed on the stacked sheet staples STA. The detected member 30 is biased downwardly by a spring, which is not shown.

Provided on a lower surface 31 of the detected member 30 are forwardly and backwardly disposed two set of legs 32, 32, 33 and 33 which are abutted with an upper surface of the uppermost sheet staple ST of the stacked sheet staples STA and configured to press downwardly the stacked sheet staples STA. A front surface 34 of the detected member 30 is flush with one side surface or a front surface STa of the stacked sheet staples STA.

Provided on the opposite sides of the detected member 30 are upwardly projected protrusions 35 and 35, whose upper outside surfaces are formed with engaging portions 36 and 36 which are inserted in guide grooves 22 (see FIG. 6) formed in inner side surfaces of the case 21. The guide grooves 22 extend upwardly and downwardly to move upwardly and downwardly the detected member 30 along these guide grooves 22.

The cartridge body 20 receives the stacked sheet staples ST contained in the case 21 and has a bottom wall 23 or bottom portion having an opening 23A, a forwardly and backwardly extending guide wall 24 provided above a front portion 23B of the bottom wall 23, an engaging wall 25 for fixing the case 21 to the cartridge body 20 and so on. A transport path 26 is formed by the front portion 23B of the bottom wall 23 and guide wall 24 to transport the sheet staple ST forwardly. Provided under the bottom wall 23 is a feeding mechanism (not shown) having a feeding pawl (not shown) for feeding forwardly the sheet staple ST. A leading end of the feeding pawl is projected upwardly from the opening 23A of the bottom wall 23 and is configured to insert between the lowermost sheet staple and the staple thereon. A back portion of the guide wall 24 is formed with a raised wall 27, which has an opening 27A.

The magazine 12 includes an actuator 40 attached rotatably at an upper portion to the shaft 17 of the link member 16 and a micro-switch 50 for detecting a rotation when the actuator 40 is rotated more a predetermined angle. The micro-switch 50 is attached to a holding member 52 provided inwardly of the front wall 14. A detecting means 70 is composed of the actuator 40 and micro-switch 50 to detect the presence and absence of the sheet staple ST. The detecting means 70 is disposed sideward of the stacked sheet staples STA. In addition, the actuator 40 and micro-switch 50 are omitted in FIG. 1.

The actuator 40 is formed into a C shape, whose leading end has an abutment part 41. An intermediate portion of the actuator 40 is provided with a forwardly (right direction in FIG. 2) projected protrusion 45 to which a spring 46 is attached. The spring 46 is engaged at one end with the front wall 14 and at the other end with the actuator 40 to be biased the actuator 40 clockwise (in FIG. 2) about the shaft 17 by a biasing force of the spring 46.

The abutment part 41 is inserted in the opening 27A of the raised wall 27 of the cartridge body 20 and an abutment surface 42 of the abutment part 41 is abutted with the one side surface STa of the stacked sheet staples. The abutment surface 42 is formed into a flat shape and ends upwardly and downwardly. An upper portion of the actuator 40 is formed with a forwardly (right direction in FIG. 2) projected protrusion 43.

A detecting part 51 of the micro-switch 50 abuts with an upper portion of the protrusion 43 to turn ON the micro-switch 50.

When the actuator 40 biased clockwise by the spring 46 is rotated clockwise a predetermined angle, the detecting part 51 is projected downwardly and configured to turn OFF the micro-switch 50.

A sheet staple detecting mechanism 60 is composed of the detected member 30, actuator 40 and micro-switch 50.

Next, an operation of the sheet staple detecting mechanism 60 configured as described above will be explained.

As shown in FIG. 2, if the sheet staples ST are stacked more a predetermined number in the case 21, the abutment surface 42 of the abutment part 41 of the actuator 40 abuts with the one side surface STa of the stacked sheet staples ST. When the number of the stacked sheet staples ST becomes less, because the height becomes low, an upper portion of the abutment surface 42 of the abutment part 41 of the actuator 40 abuts with the front surface 34 of the detected member 30.

Figure 6:
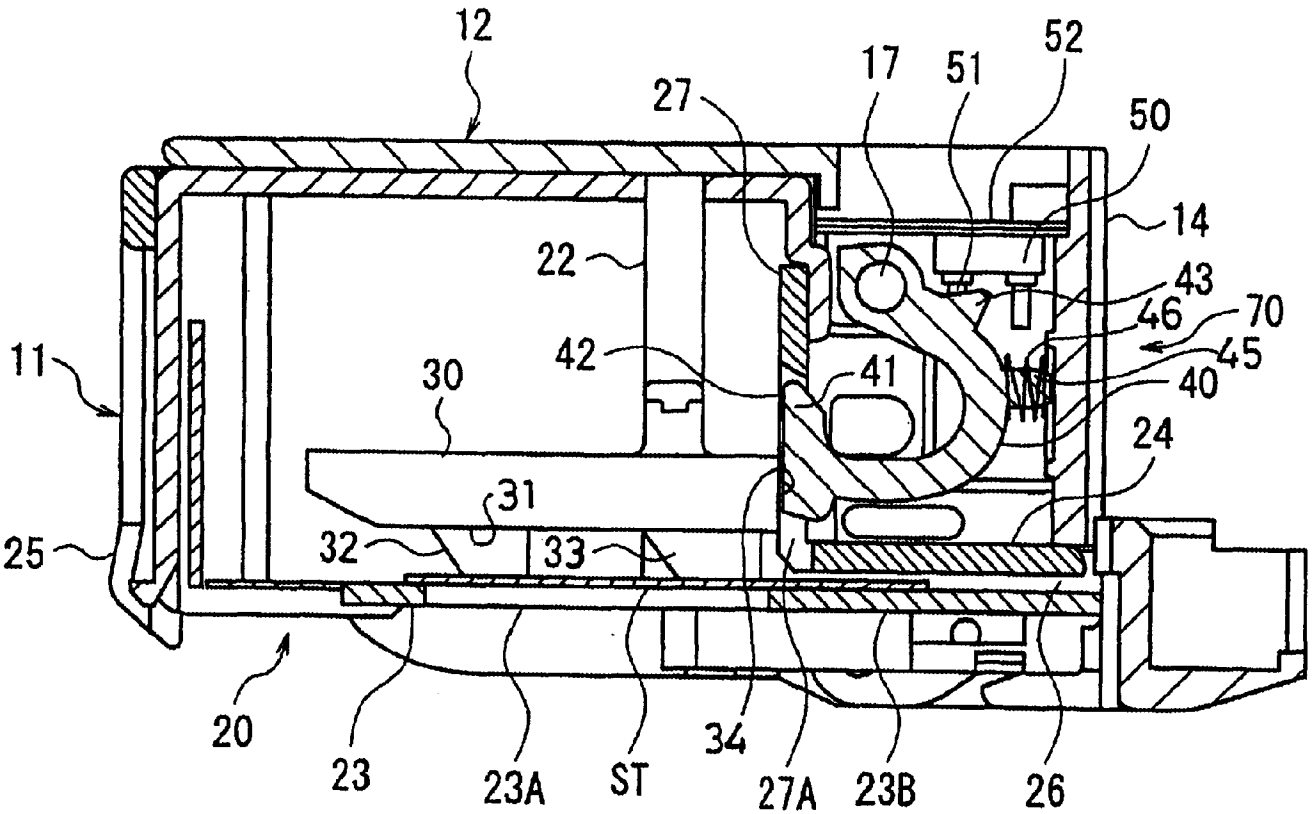
FIG. 6 is an explanatory view showing one remained sheet staple.

If there become a few stacked sheet staples, the abutment surface 42 of the abutment part 41 of the actuator 40 abuts with only the front surface of the detected member 30. If there becomes one sheet staple, as shown in FIG. 6, because leg part 32, 32, 33 and 33 of the detected member 30 are laid on the upper surface of the sheet staple, the front surface of the detected member 30 abuts with a lower portion of the abutment surface 42 of the abutment part 41 of the actuator 40.

Figure 7:
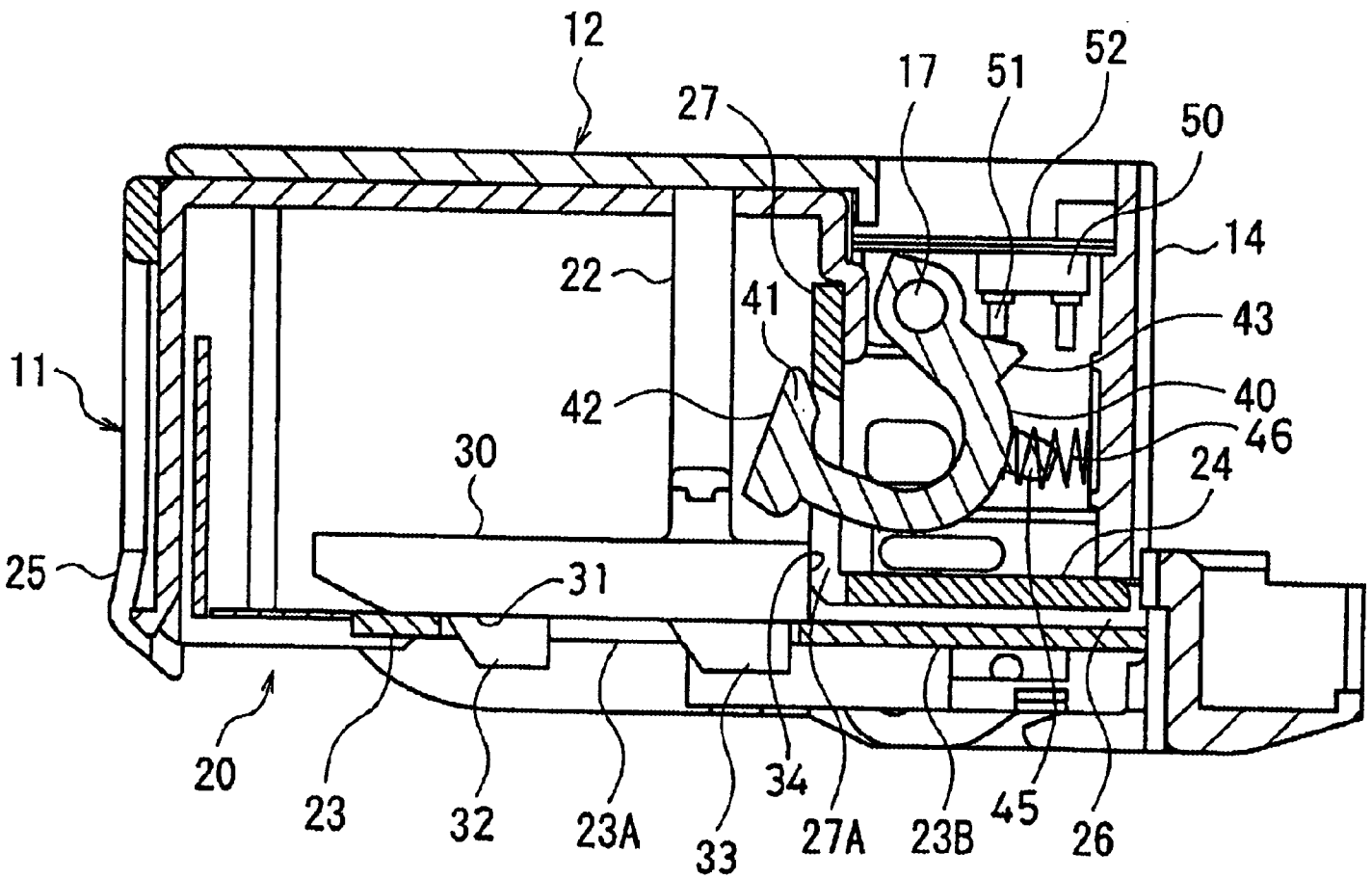
FIG. 7 is an explanatory view showing a state that the stacked sheet staples are absent.

When the sheet staples ST become zero, namely, absent, the leg parts 32, 32, 33 and 33 of the detected member 30 are inserted in the opening 23A of the bottom 23 of the cartridge body 20, as shown in FIG. 7. The position of the upper surface of the detected member 30 is dropped by the height of the lower leg part 32,32, 33 and 33, in other words, is moved to a position lowered on step, therefore, the abutment surface 42 of the abutment part 41 of the actuator 40 is removed from the front surface 34 of the detected member 30 to rotate the actuator 40 clockwise.

The clockwise rotation of the actuator 40 causes the micro-switch 50 to turn OFF. The OFF of the micro-switch 50 results in the decision of the absence of the sheet staples.

In this way, when the sheet staples ST become absent, because the leg parts 32, 32, 33 and 33 of the detected member 30 are inserted in the opening 23A of the bottom wall 23 of the cartridge body 20, the position of the upper surface of the detected member 30 is dropped by the height of the lower leg parts 32, 32, 33 and 33. Consequently, the abutment surface 42 of the abutment part 41 of the actuator 40 is removed firmly from the front surface 34 of the detected member 30. In other words, the removal of abutment to the detected member 30 by the actuator 40 is firmly carried out to detect completely the presence and absence of the sheet staples ST.

By the way, because the detecting means 70 for detecting the presence and absence of the sheet staples ST is disposed sideward of the stacked sheet staples STA, the driver unit 10 is not bulky upwardly and downwardly and the miniaturization thereof, in other words, of the electric stapler can be accomplished, because the actuator 40 and micro-switch 50 in the detecting means 70 are arranged inwardly of the front wall 14.

Moreover, because the detecting means 70 and detected member 30 are not arranged downwardly of the stacked sheet staples ST, the driver unit 10 and clincher unit can also be applied to the upwardly and downwardly separated type electric stapler. Also, by the detecting means 70 and so on being not provided under the cartridge body 20, since there no need to project upwardly the leading end of the actuator for detecting from the bottom wall 23, it is possible to carry out simply the insertion of the cartridge 11 into the magazine 12.

In the above mode for carrying out, although the actuator 40 and micro-switch 50 are provided one by one, if a plurality of actuators and micro-switches are provided and the height positions of the abutment parts 41 are set to become different, respectively, it is possible to detect the remaining amount of the sheet staples ST. In this case, the micro-switch 50 of the detecting means 70 may be replaced by a photo-interrupter.

Further, although the detecting means 70 is disposed sideward of the stacked sheet staples STA, it may be disposed upwardly of the stacked sheet staples.

Second Mode for Carrying Out

Figure 8:
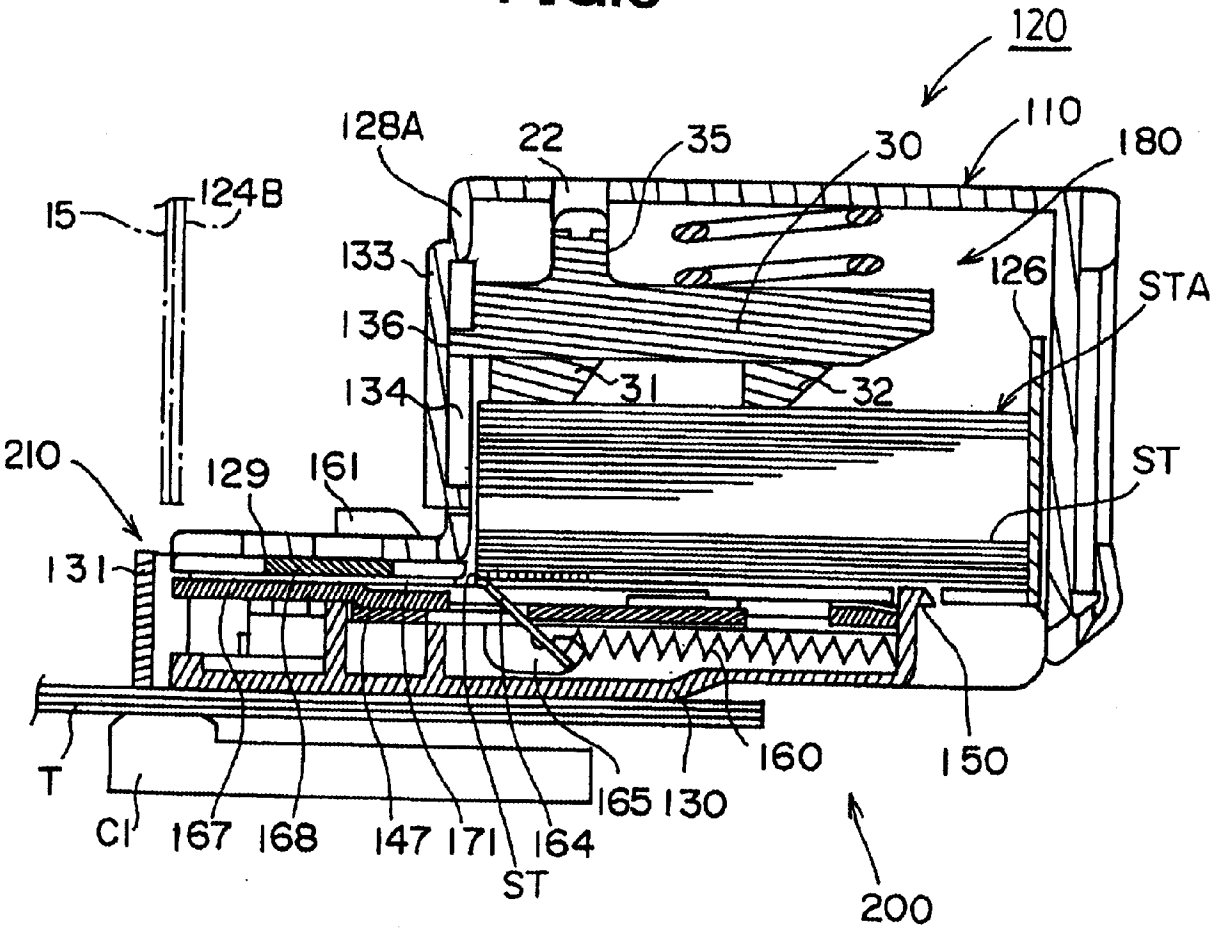
FIG. 8 is a sectional view showing a structure of a cartridge in a second mode.

FIG. 8 illustrates a cartridge for an electric stapler in a second mode for carrying out.

The cartridge 120 shown in FIG. 8 comprises a body case 110 for the cartridge, a pressing means 180 provided in the body case 110 and a sending means 200 provided under the body case 110. In addition, 124B is a forming plate, C1 a clincher.

Figure 10:
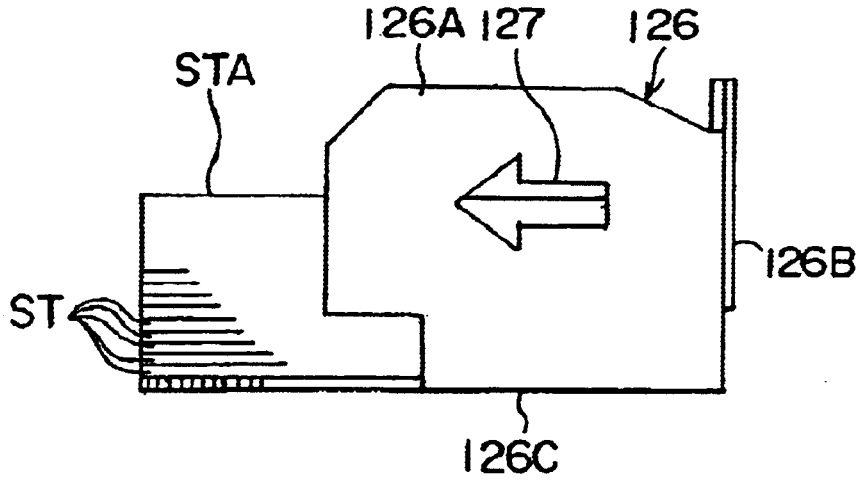
FIG. 10 is a side view showing the stacked sheet staples and a containing case.

Housed in the body case 110 is a containing case 126, in which stacked sheet staples STA, configured to stack sheet staples ST, are contained. The containing case 126 has a pair of sidewalls 126A and a back wall 126B. Lower edge portions of the pair of sidewalls 126A are connected through a bottom wall 126C, as shown in FIG. 10.

One sidewall is formed with an arrow-shaped opening 127. The opening 127 is configured to show a direction of feeding the sheet staple ST and to judge about whether or not a posture of the containing case 126 when the stacked sheet staples STA are loaded therein is proper.

Formed integrally with a lower portion of a left side surface of the body case 110 is a leftward (forwardly) extending transport cover part 129 which is provided at a leading end side with a drive-out part 210 for driving the sheet staple. An upper portion of the body case 110 is opened, in its opening a lower plate 167 which will be explained is disposed.

Figure 9:
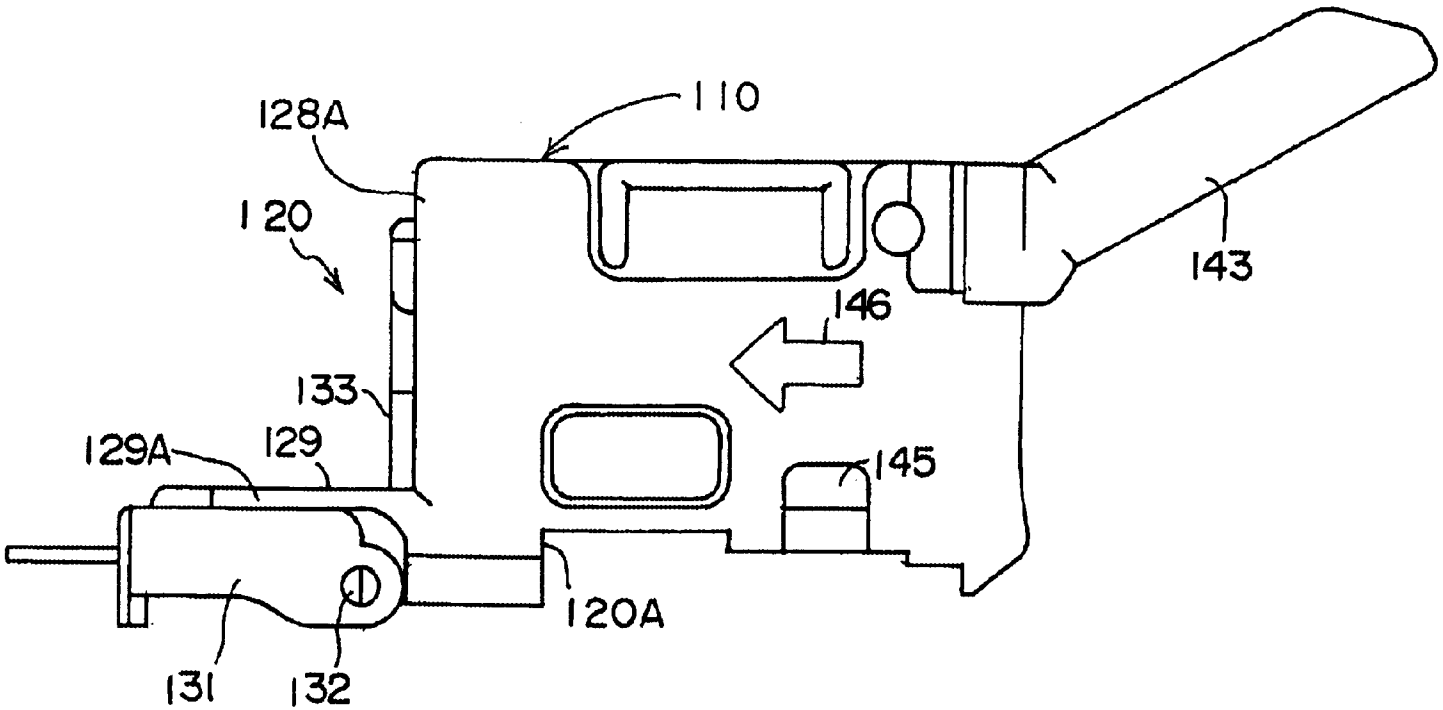
FIG. 9 is a side view showing an external appearance of the cartridge.

A faceplate 131 is pivoted rotatably through a pin 132 on a sidewall 129A of the transport cover part 129, as shown in FIG. 9. An engaging protrusion (not shown) is formed inside the sidewall 129A of the transport cover part 129.

Figure 13:
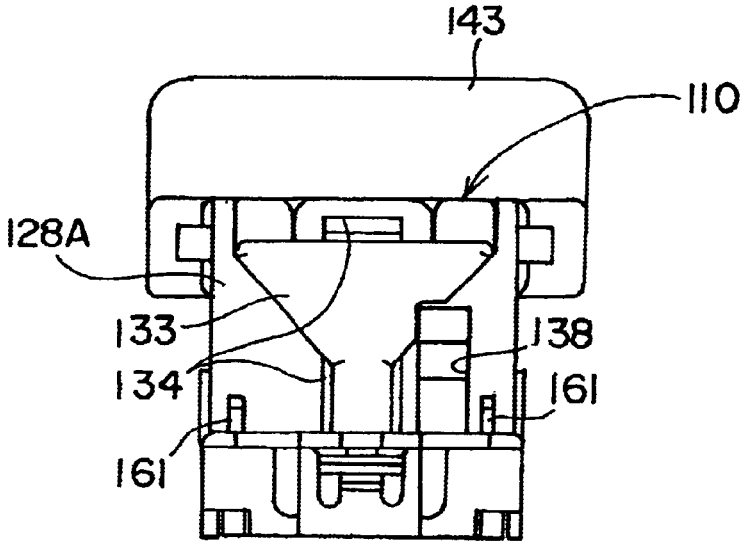
FIG. 13 is a front view showing the external appearance of the cartridge in the second mode.

A front surface of a front wall portion 128A of the body case 110 is formed integrally with a triangle latching part 133, as shown in FIG. 13. The front wall part 128A facing the latching part 133 is formed with an upwardly and downwardly extending opening 134 and a lower end portion of the latching part 133 extends to the vicinity of a lower end portion of the opening 134 (see FIG. 8).

The front wall portion 128A is also formed with an opening 138 foe detecting the presence and absence of the sheet staples ST in the body case 110, as shown in FIG. 13.

Figure 14:
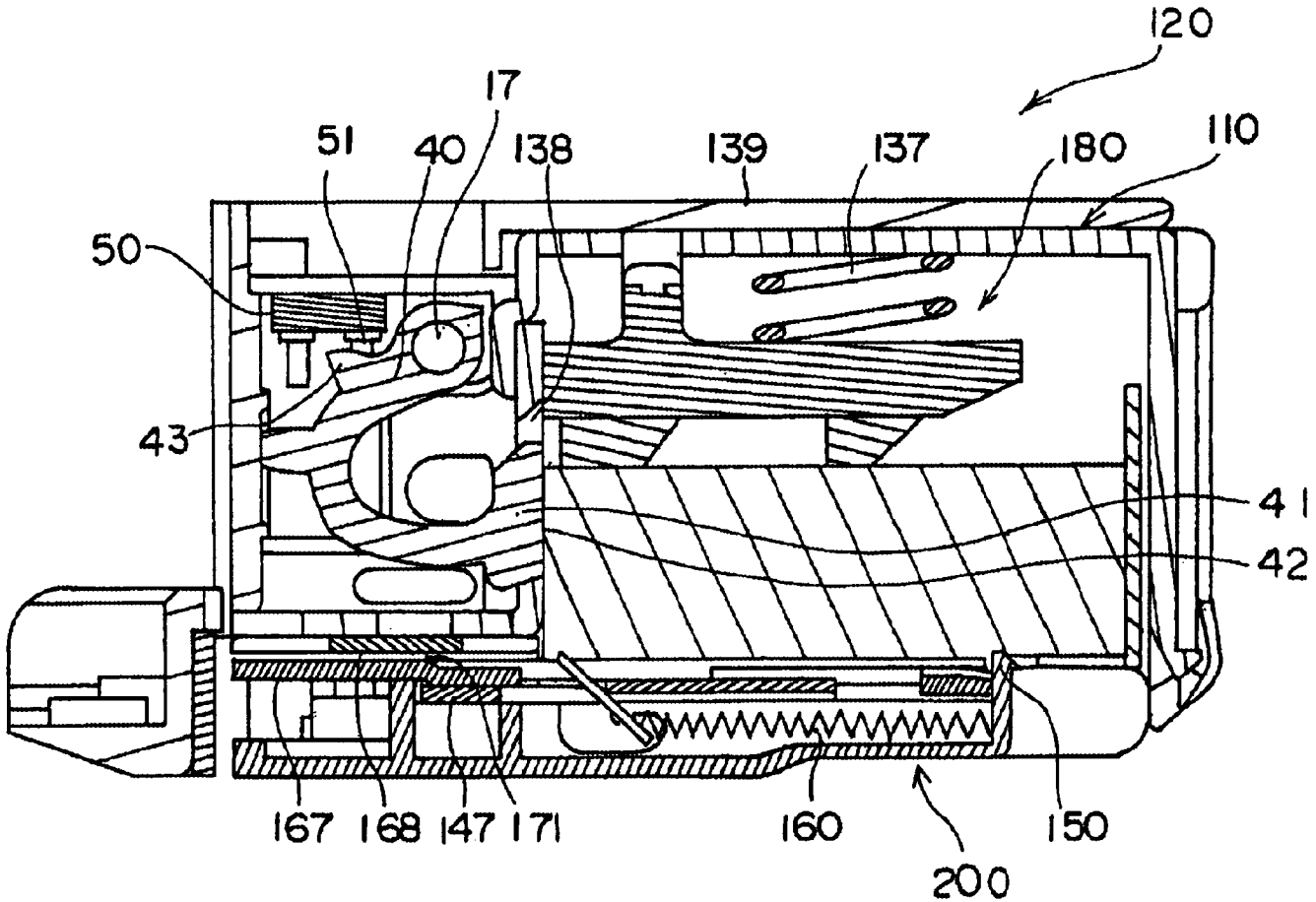
FIG. 14 is a sectional view showing the cartridge mounted on the magazine.

The abutment part 41 of the actuator 40 provided on the magazine 139 is inserted in the opening 138, as shown in FIG. 14.

On a back portion of the body case 110 is provided a lever 143 for taking out the cartridge 120 from the magazine 139, as shown in FIG. 9. Right and left sidewalls of he body case 110 are formed with concave portions 145 in which engaging protrusions 144 of a supporting base 130 which will be explained, are inserted. One of the sidewalls is provided with an arrow 146 for showing a direction of inserting the cartridge 120 into the magazine 139.

As shown in FIG. 8, the feeding means 200 comprises the support base 130 attached on the lower portion of the base case 110, a slide plate 147 mounted forwardly and backwardly movably on the support base 130, a lower plate 167 mounted on the support base 130 (see FIG. 18), an upper plate 168 mounted on the lower plate 167 and so on.

Figure 15:
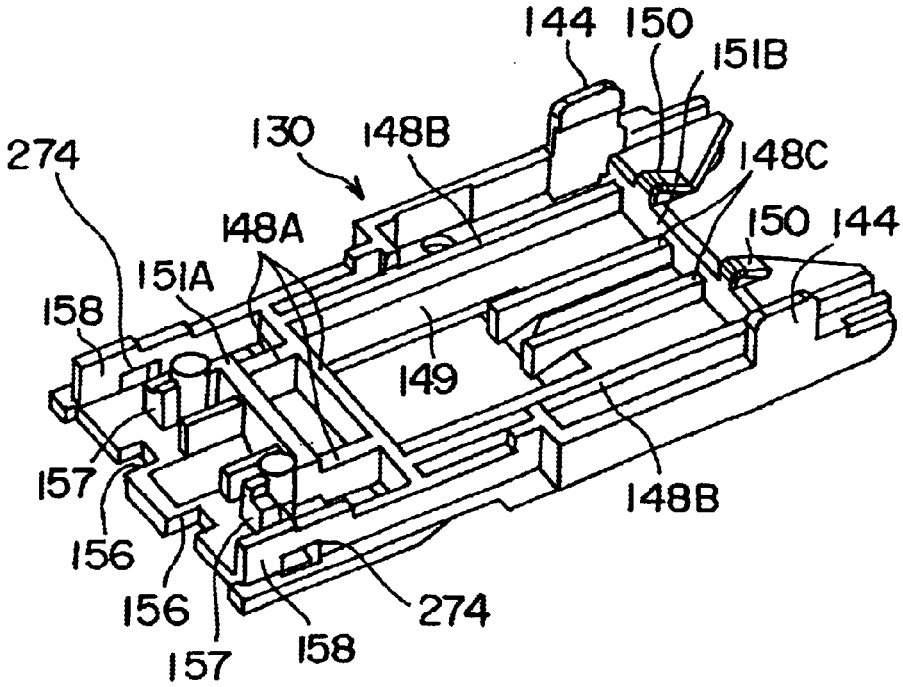
FIG. 15 is a perspective view showing the supporting base shown in FIG. 11.

As shown in FIG. 15, the support base 130 is formed with ribs 148A for supporting a front end portion of the slide plate 147, a pair of ribs 148B for supporting right and left edge portions of the slide plate 147 and extending forwardly and backwardly and ribs 148 C for supporting a back portion of the slide plate 147. The support base 130 is also formed with a limiting rib 151A provided on front sides of the ribs 148A for limiting a forward movement of the slide plate 147 and a limiting rib 151B provided on back ends of the ribs 148B for limiting a backward movement of the slide plate 147.

The limiting rib 151B is provided with a pair of protrusions 150 as a main element of an inclined means for lifting a back portion of the stacked sheet staples STA and inclining the stacked sheet staples.

Figure 11:
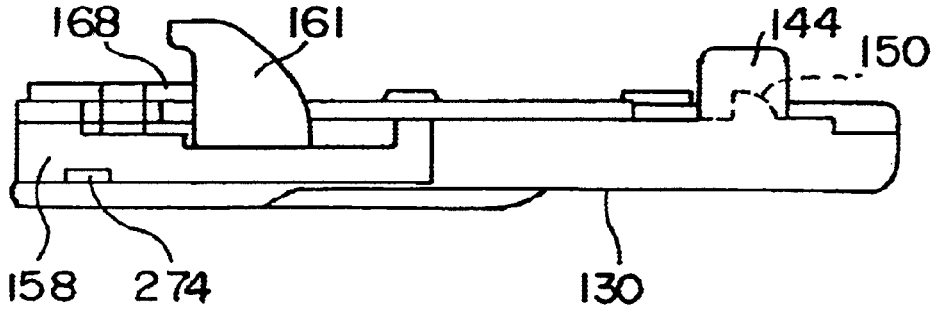
FIG. 11 is a sectional view showing a supporting base.
Figure 12:
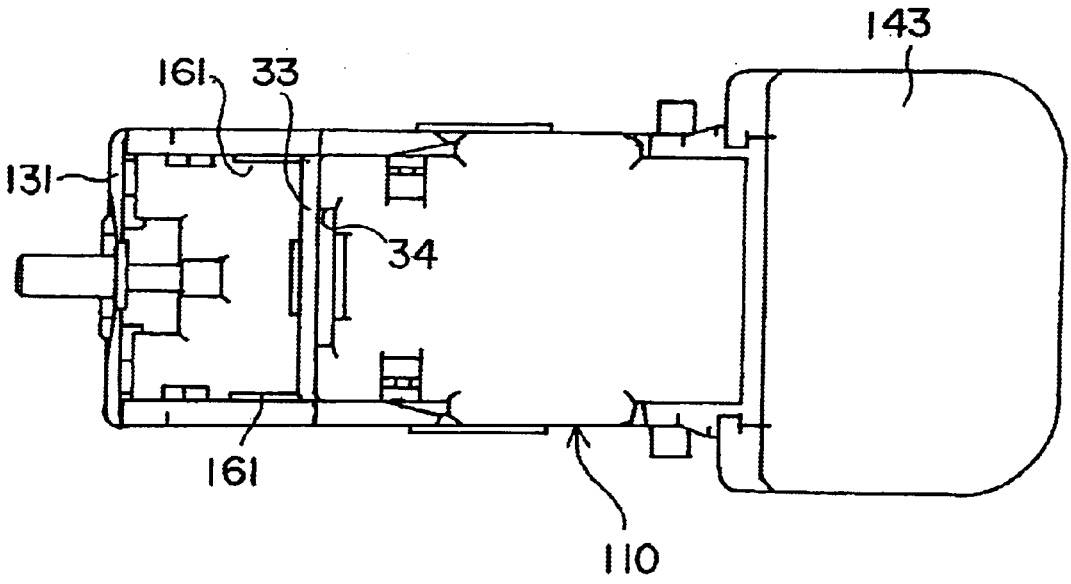
FIG. 12 is a plan view showing the external appearance of the cartridge in the second mode.

Front ends of a pair of sidewalls 158 of the support base 130 are provided with openings 274, as shown in FIG. 11. Engaging protrusions 144 are provided on both sides of back portions of the support base 130.

In the second mode, although the inclined means is composed of the pair of protrusions 150 and the pressing means 180 as described above, only the protrusions 150 may be used to lower a front end of the stacked sheet staples STA.

The pair of protrusions 150, also, is formed on the support base 130. However, the pair of protrusions 150 may be formed by projection of a back end portion of the lower plate 167, which will be explained, by means of a press forming. If a pair of protrusions substituted for the protrusions 150 are formed on the lower plate 167, a band-shaped protrusion may be formed to extend in a direction of width of the lower plate 167 without the configuration of the pair of protrusions.

Figure 16:
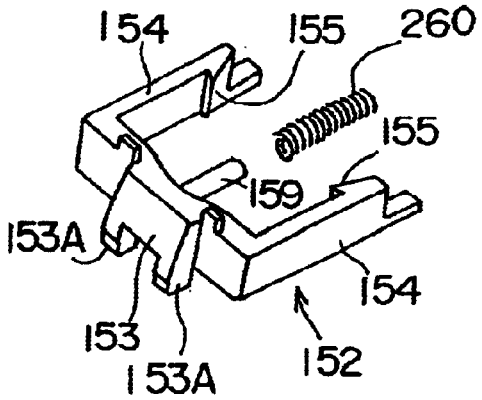
FIG. 16 is an exploded perspective view showing a structure of a pusher.

On a front portion of the support base 130 is disposed a pusher 152 as shown in FIG. 16.

The pusher 152 has a taper portion 153, which is slightly inclined, on whose both sides are formed backwardly extending latching portions 154.

Hook portions 155 are formed on inner surfaces of back end portions of the latching portions 154. When the pusher 152 is attached on the support base 130, the taper portion 153 faces the aforementioned faceplate 131 and a staple bent in a U character shape is adapted to be sandwiched between the taper portion 153 and the faceplate 131. The sandwiched staple is driven out downwardly by means of the driver 15.

A pair of protrusions 153A projected on both sides of an upper portion of the taper portion 153 is inserted into guide grooves 156 provided in a leading end of the support base 130. The pair of latching portions 154 is inserted between the protrusions 157 of the support base 130 and the sidewalls 158 and the pusher 152 is attached forwardly and backwardly movably on the support base 130.

The hook portions 155 of the pusher 152 engage with the protrusions 157 so that the forward movement of the pusher 152 is limited. A spring 260 is provided on a shaft 159 formed on a back surface of the taper portion 153. A back end of the spring 260 is supported on the limiting rib 151A. The spring 260 biases the pusher 152 forwardly.

Figure 17A:
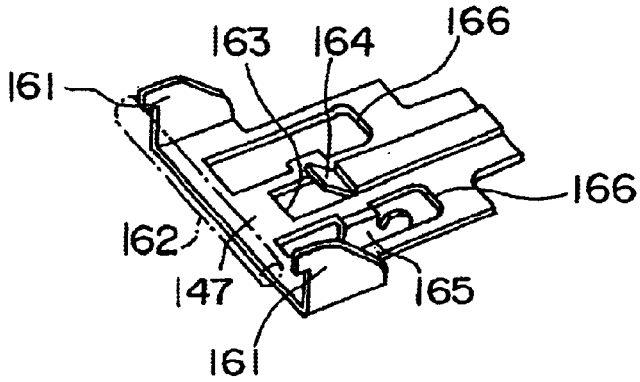
FIG. 17
Figure 17B:
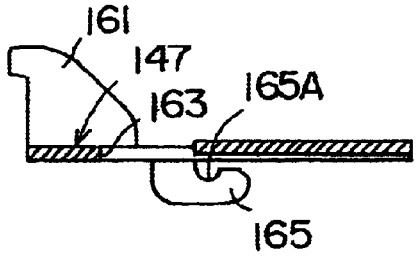
Figure 17C:
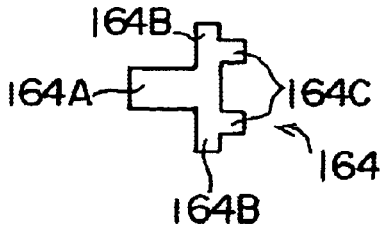

The slide plate 147 has at both sides a pair of engaging pawls 161, as shown in FIGS. 17 (A) and (B). The engaging pawls 161 are pressed by a shaft 162 passing through laterally the magazine 139 and the slide plate 147 is moved to slide backwardly by the pawls 161 being pressed by the shaft 162. The slide plate 147 is formed at a central portion with an opening 163 in which a leading end of a feeding pawl 164 is inserted from beneath and projected upwardly.

The slide plate 147 is also formed with a pair of openings 166 extending forwardly and backwardly at both sides of the opening 163. Formed on a side edge portion of each opening 166 is a hook 165 for holding the feeding pawl 164.

As shown in FIG. 17 (C), the feeding pawl 164 has a pawl portion 164A engaging between the staples, a protrusion 164B supported in a concave portion 165A of the hook 165 and a holding portion 164C for holding the spring 160 (see FIG. 8). The feeding pawl 164A is pressed by a biasing force of the spring 160 to rotate clockwise the holding portion 164C of the feeding pawl 164 in the concave portion 165A of the hook 165 of the slide plate 147, thus rotating the feeding pawl 164A clockwise. By the clockwise rotation, the pawl portion 164A of the feeding pawl 164 is adapted to extend upwardly from the opening 163 of the slide plate 147.

The spring 160 is disposed between the pair of ribs 148C (see FIG. 15) of the support base 130. A back end of the spring 160 is engaged with the limiting rib 151B of the support base 130.

Figure 18A:
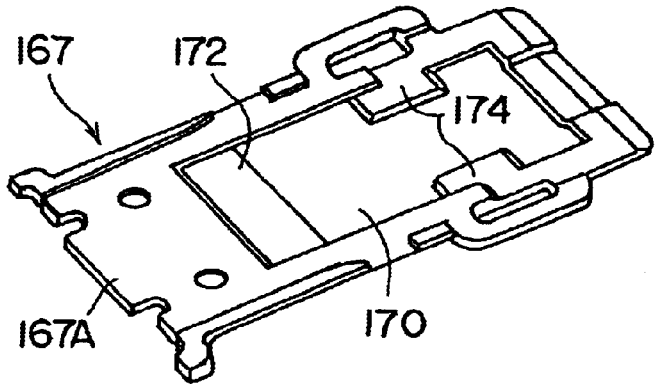
Figure 18:
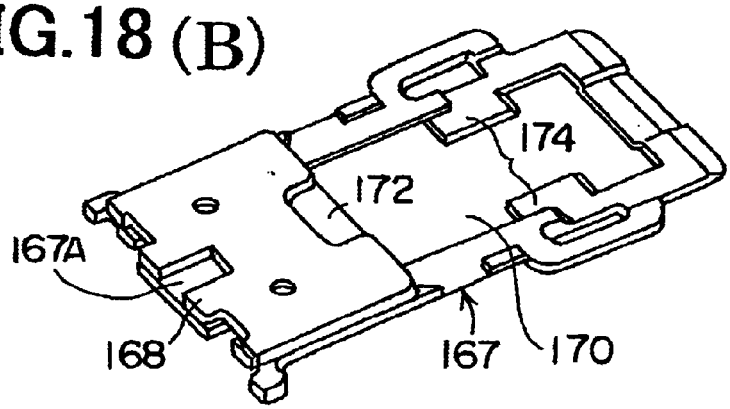

FIG. 18 (A) illustrates the lower plate 167 having a guide portion 167A forming a lower side of a transport path 171. The lower plate 167 has an opening 170 and a receiving surface 174 for receiving the stacked sheet staples STA. The receiving surface 174 is lowered one step than the guide portion 167. The lower plate 167 is formed with a stepped portion 172 for guiding the sheet staples ST received by the receiving surface 174 to the guide portion 167A. The leg parts 32, 32, 33 and 33 of the detected member 30 are configured to insert in the opening 170 of the lower plate 167 and opening 166 of the slide plate 147, if the sheet staples ST laid on the receiving surface 174 of the lower plate 167 are absent.

FIG. 19 illustrates the upper plate 168 forming an upper side of the transport path 171.

The upper plate 168 is disposed on the guide portion 167A of the lower plate 167 to form the transport path 171 together the lower plate 167. The transport cover part 129 is disposed to cover the upper plate 168 (see FIG. 8).

As shown in FIG. 8, the slide plate 147 is disposed under the lower plate 167 and configured to be movable forwardly and backwardly.

The protrusions 160 of the inclined means project upwardly than the guide portion 167A of the lower plate 167. The feeding pawl 164 of the slide plate 147 is disposed in the opening 170 of the lower plate 167 to be movable forwardly and backwardly together the slide plate 147.

In addition, the engaging protrusion (not shown) inside of the sidewall 129A of the transport cover part 129 are engaged in the openings 274 in the sidewalls 158 of the support base 130 and the engaging protrusions 144 of the support base 130 are engaged in the concave potion 145 of the body case 110 so that the support base 130 is attached to the body case 110.

The pressing means 180 is composed of the detected member 30 and the coil spring (biasing member) 137 for biasing downwardly the detected member 30.

Because the leg parts 32 of the detected member 30 are positioned forwardly than the position of the protrusions 150 of the support base 130, the stacked sheet staples STA are inclined in such a manner that the back portion of the stacked sheet staples STA is lifted upwardly and the forward end of the stacked sheet staples STA is lowered downwardly by the protrusions 150 of the support base 130.

As a result, the sheet staple ST is inclined as shown in FIG. 22. By the inclination, even if the sheet staple ST is curved forwardly and backwardly in such a manner that the lower surface of the central portion of the sheet staple is in a convex shape, the leading end STa of the sheet staple ST can be prevented from abutting with the upper edge 171*a* of the entrance of the transport path 171, and therefore the sheet staple ST can be fed firmly to the transport path 171.

Moreover, when the sheet staple ST is fed by the feeding pawl 164, if there becomes one sheet staple, a leading end of the sheet staple becomes is easy to lift upwardly by the feeding pawl 164, but, because the leg parts 33 of the detected member 30 are disposed upwardly of the feeding pawl 164, the lifting can be avoided.

Consequently, the pawl portion 164A of the feeding pawl 164 can be engaged firmly between the sheet staples, one sheet staple can be fed firmly to the transport path 171.

In the cartridge 120 in the second mode, because the inclined means is composed of the pair of protrusions 150 provided on the support base 130, the coil spring 137 for pressing the stacked sheet staples STA on the support base 130 from above and detected member 30, for example, even if the cartridge is loaded in the magazine 139 to become upside down, the sheet staple ST can be fed firmly to the transport path 171.

In the second mode, although the actuator 40 and micro-switch 50 are provided, similarly as in the first mode, in case of intending only the supply of the sheet staple ST to the transport path 171 firmly, the actuator 40 and micro-switch 50 are not required, and further it also is not required that the leg parts 32, 32, 33 and 33 of the detected member 30 are inserted in the opening 170 of the lower plate 167 and openings 166 of the slide plate 147.

EFFECT OF INVENTION

As described above, according to the present invention, it is possible to apply for an electric stapler of upwardly and downwardly separated type and to miniaturize the electric stapler.

Moreover, even if a sheet staple is curved, it is possible to feed the same to a transport path firmly.

What is claimed is:

1. A cartridge, comprising:

a detected member for detecting presence and absence of sheet staples stacked on a bottom having an opening, wherein said detected member comprises a leg part which is laid on an uppermost sheet staple of the stacked sheet staples, and when a sheet staple is not laid on the bottom, the leg part is entered in the opening of the bottom and the detected member is moved to a lowered position.

2. The cartridge according to claim 1, further comprising a detecting means for detecting the presence and absence of the sheet staples by detecting whether or not the detected member is moved to the lowered position.

3. The cartridge according to claim 2, further comprising a drive out part for driving the sheet staple and a transport path for sending the sheet staple to the drive out part, and an inclined means for inclining the sheet staples by lifting a back portion of the sheet staples when the sheet staple is sent.

4. The cartridge according to claim 3, wherein said inclining means comprises a protrusion provided on the bottom and a pressing means for pressing downwardly a front side of the sheet staple more than the protrusion.

5. The cartridge according to claim 4, wherein said pressing means comprises the detected member and a biasing means for biasing downwardly the detected member.

6. The cartridge according to claim 1, wherein said detected member comprises one side surface flush with a side surface of the stacked sheet staples, said detecting means comprises one end rotatably pivoted, an actuator provided with an abutment part for abutting with the side surface of the stacked sheet staples and a micro-switch for detecting rotation of the actuator, said abutment part contacting with the one side surface of the detected member when the number of the stacked sheet staples is less than a predetermined number, said abutment part being out of the one side surface of the detected member and the actuator being rotated, when the sheet staple is not laid on the bottom.

7. The cartridge according to claim 6, further comprising a drive out part for driving the sheet staple and a transport path for sending the sheet staple to the drive out part, and an inclined means for inclining the sheet staples by lifting a back portion of the sheet staples when the sheet staple is sent.

8. The cartridge according to claim 7, wherein said inclining means comprises a protrusion provided on the bottom and a pressing means for pressing downwardly a front side of the sheet staple more than the protrusion.

9. The cartridge according to claim 8, wherein said pressing means comprises the detected member and a biasing means for biasing downwardly the detected member.

10. The cartridge according to claim 1, further comprising a drive out part for driving the sheet staple and a transport path for sending the sheet staple to the drive out part, and an inclined means for inclining the sheet staples by lifting a back portion of the sheet staples when the sheet staple is sent.

11. The cartridge according to claim 10, wherein said inclining means comprises a protrusion provided on the bottom and a pressing means for pressing downwardly a front side of the sheet staple more than the protrusion.

12. The cartridge according to claim 11, wherein said pressing means comprises the detected member and a biasing means for biasing downwardly the detected member.

* * * * *